US011769401B2

(12) United States Patent
Masuda et al.

(10) Patent No.: US 11,769,401 B2
(45) Date of Patent: Sep. 26, 2023

(54) VEHICLE, TRAFFIC SIGNAL CONTROL METHOD, AND PROGRAM

(71) Applicant: TOYOTA JIDOSHA KABUSHIKI KAISHA, Toyota (JP)

(72) Inventors: Taizo Masuda, Yokohama (JP); Miki Nomoto, Nisshin (JP); Yuta Kataoka, Susono (JP); Hiromitsu Kobayashi, Nisshini (JP); Yoshiki Ueda, Susono (JP); Satoshi Omi, Ebina (JP); Yuki Nishikawa, Susono (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 19 days.

(21) Appl. No.: 17/551,964

(22) Filed: Dec. 15, 2021

(65) Prior Publication Data

US 2022/0262242 A1 Aug. 18, 2022

(30) Foreign Application Priority Data

Feb. 17, 2021 (JP) ..... 2021-023620

(51) Int. Cl.

| | |
|---|---|
| ***G08G 1/01*** | (2006.01) |
| ***G08G 1/056*** | (2006.01) |
| ***G08G 1/087*** | (2006.01) |

(52) U.S. Cl.

CPC ..... *G08G 1/0145* (2013.01); *G08G 1/0112* (2013.01); *G08G 1/0125* (2013.01); *G08G 1/056* (2013.01); *G08G 1/087* (2013.01)

(58) Field of Classification Search

CPC .. G08G 1/0145; G08G 1/0112; G08G 1/0125; G08G 1/056; G08G 1/087; G08G 1/08

See application file for complete search history.

(56) References Cited

U.S. PATENT DOCUMENTS

| | | | | |
|---|---|---|---|---|
| 11,170,643 | B1 * | 11/2021 | Carter | G08G 1/087 |
| 2020/0380866 | A1 * | 12/2020 | Wu | G08G 1/161 |

FOREIGN PATENT DOCUMENTS

| | | | |
|---|---|---|---|
| JP | 2006-236094 | A | 9/2006 |
| JP | 2012-221091 | A | 11/2012 |

* cited by examiner

*Primary Examiner* — Joseph H Feild
*Assistant Examiner* — Sharmin Akhter
(74) *Attorney, Agent, or Firm* — Dinsmore & Shohl LLP

(57) ABSTRACT

A vehicle includes a sensor that detects a traffic signal installed in a travel route of the own vehicle, another vehicle traveling around the own vehicle, and another mobile object around the own vehicle. After recognizing that the own vehicle has passed the traffic signal, the vehicle determines whether or not there are the other mobile object moving toward the traffic signal and the other vehicle moving beside the other mobile object toward the traffic signal. When determining that there are the other mobile object moving toward the traffic signal and the other vehicle moving beside the other mobile object toward the traffic signal, the vehicle controls the traffic signal based on a traveling state of the other vehicle.

6 Claims, 18 Drawing Sheets

VEHICLE, TRAFFIC SIGNAL CONTROL METHOD, AND PROGRAM

CROSS-REFERENCE TO RELATED APPLICATION

This application claims priority to Japanese Patent Application No. 2021-023620 filed on Feb. 17, 2021, incorporated herein by reference in its entirety.

BACKGROUND

1. Technical Field

The present disclosure relates to a vehicle, a traffic signal control method, and a program.

2. Description of Related Art

There is a publicly known traffic signal control device (see, for example, Japanese Unexamined Patent Application Publication No. 2012-221091). The traffic signal control device includes a camera installed at an intersection of roads, and detects a traffic condition and the number of stop vehicles per route based on images taken by the camera. Based on the detection result, the traffic signal control device controls lighting time of the traffic signal installed at the intersection to support smooth traveling of vehicles.

SUMMARY

However, there is a problem that the traffic signal control device can control only the limited traffic signals that are installed with cameras.

The present disclosure provides a vehicle including: a sensor, a recognition unit, a determination unit, an estimation unit, a communication unit, and a traffic signal control unit. The sensor is configured to detect a traffic signal installed in a travel route of the own vehicle, another vehicle traveling around the own vehicle, and another mobile object around the own vehicle. The recognition unit is configured to recognize the presence of the traffic signal, the other vehicle, and the other mobile object based on a detection result of the sensor. The determination unit is configured to determine, after the recognition unit recognizes that the own vehicle has passed the traffic signal, whether or not there are the other mobile object moving toward the traffic signal and the other vehicle moving beside the other mobile object toward the traffic signal. The estimation unit is configured to estimate a traveling state of the other vehicle. The communication unit is configured to communicate with the traffic signal. The traffic signal control unit is configured to control, when the determination unit determines that there are the other mobile object moving toward the traffic signal and the other vehicle moving beside the other mobile object toward the traffic signal, the traffic signal based on the traveling state of the other vehicle estimated by the estimation unit.

The present disclosure further provides a vehicle including: a sensor, a recognition unit, an estimation unit, an advance route prediction unit, a traffic signal identification unit, a communication unit, and a traffic signal control unit. The sensor is configured to detect another vehicle traveling around the own vehicle. The recognition unit is configured to recognize the presence of the other vehicle based on a detection result of the sensor. The estimation unit is configured to estimate a current position and a traveling state of the other vehicle recognized by the recognition unit based on the detection result of the sensor. The advance route prediction unit is configured to predict an advance route of the other vehicle based on the current position and the traveling state of the other vehicle estimated by the estimation unit. The traffic signal identification unit is configured to identify, based on the advance route of the other vehicle predicted by the advance route prediction unit and acquired installation positions of traffic signals, the traffic signal that the other vehicle is expected to pass through. The communication unit is configured to communicate with the identified traffic signal. The traffic signal control unit is configured to control the identified traffic signal based on the traveling state of the other vehicle estimated by the estimation unit.

The present disclosure further provides a traffic signal control method. The traffic signal control method includes: recognizing the presence of a traffic signal installed in a travel route of an own vehicle, another vehicle traveling around the own vehicle, and another mobile object around the own vehicle based on a detection result of a sensor that detects the traffic signal, the other vehicle, and the other mobile object; determining, after recognizing that the own vehicle has passed the traffic signal, whether or not there are the other mobile object moving toward the traffic signal and the other vehicle moving beside the other mobile object toward the traffic signal; estimating a traveling state of the other vehicle; communicating with the traffic signal; and controlling, when determining that there are the other mobile object moving toward the traffic signal and the other vehicle moving beside the other mobile object toward the traffic signal, the traffic signal based on the estimated traveling state of the other vehicle.

The present disclosure further provides a program for causing a computer to perform functions. The function includes: recognizing the presence of a traffic signal installed in a travel route of an own vehicle, another vehicle traveling around the own vehicle, and another mobile object around the own vehicle based on a detection result of a sensor that detects the traffic signal, the other vehicle, and the other mobile object; determining, after recognizing that the own vehicle has passed the traffic signal, whether or not there are the other mobile object moving toward the traffic signal and the other vehicle moving beside the other mobile object toward the traffic signal; estimating a traveling state of the other vehicle; communicating with the traffic signal; and controlling, when determining that there are the other mobile object moving toward the traffic signal and the other vehicle moving beside the other mobile object toward the traffic signal, the traffic signal based on the estimated traveling state of the other vehicle.

It is possible to control traffic signals over a wide range.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
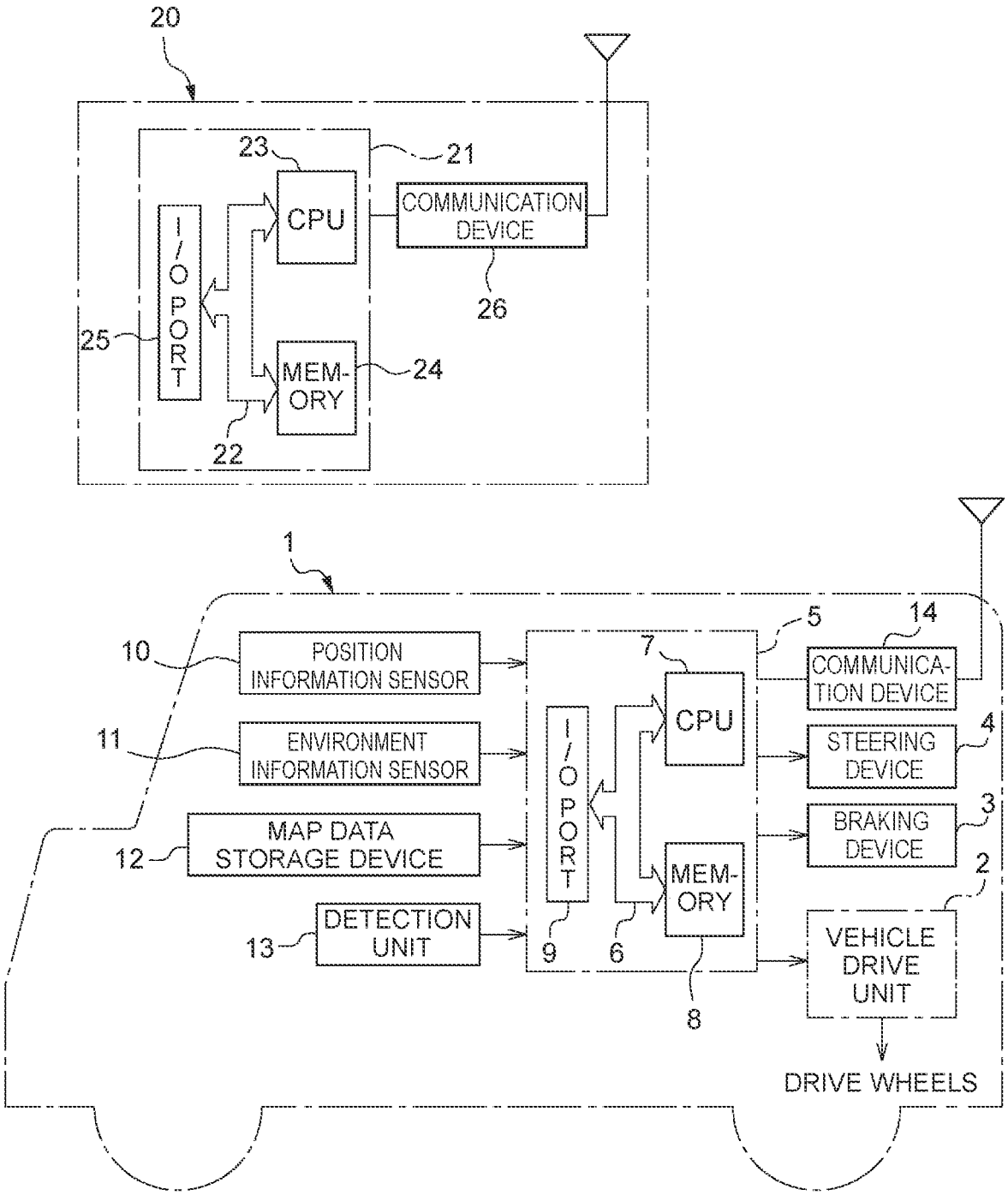
FIG. 1 graphically shows a vehicle and a server.

With reference to FIG. 1, reference numeral 1 graphically denotes a vehicle. In an embodiment according to the present disclosure, the vehicle 1 is constituted of a loop bus configured to travel autonomously along a preset travel route within a preset region. In FIG. 1, reference numeral 2 denotes a vehicle drive unit that provides driving force to a drive wheel of the vehicle 1, reference numeral 3 denotes a braking device that brakes the vehicle 1, reference numeral 4 denotes a steering device that steers the vehicle 1, and reference numeral 5 denotes an electronic control unit mounted in the vehicle 1. As shown in FIG. 1, the electronic control unit 5 is constituted of a digital computer including a CPU (microprocessor) 7, a memory 8 constituted of a ROM and a RAM, and an input-output port 9 which are connected with each other through a bidirectional bus 6.

Meanwhile, as shown in FIG. 1, the vehicle 1 includes a position information sensor 10, an environment information sensor 11, a map data storage device 12, and a detection unit 13. The position information sensor 10 is a sensor for detecting the current position of the vehicle 1. The position information sensor 10 is constituted of, for example, a global positioning system (GPS) receiver that receives electric waves from artificial satellites and detects the current position of the vehicle 1. The environment information sensor 11 is constituted of a sensor that detects the state of the vehicle 1 and a sensor that detects the periphery of the vehicle 1 to make the vehicle 1 travel autonomously. In this case, an acceleration sensor, a speed sensor, and an azimuth sensor are used as the sensor to detect the state of the vehicle 1. As the sensor to detect the periphery of the vehicle 1, a camera that photographs an area in front of the vehicle 1 or the like, a LIDAR, a radar, or other sensors are used.

Meanwhile, the map data storage device 12 stores map data and the like necessary for vehicle 1 to travel autonomously. The detection unit 13 is constituted of, for example, various sensors for detecting getting-on-and-off behaviors of passengers getting on or off the loop bus. The position information sensor 10, the environment information sensor 11, the map data storage device 12, and the detection unit 13 are connected to an electronic control unit 5.

Meanwhile, reference numeral 20 denotes a server in FIG. 1. As shown in FIG. 1, an electronic control unit 21 is provided in the server 20. The electronic control unit 21 is constituted of a digital computer including a CPU (microprocessor) 23, a memory 24 constituted of a ROM and a RAM, and an input-output port 25 which are connected with each other through a bidirectional bus 22. Furthermore, in the server 20, a communication device 26 is provided to communicate with the vehicle 1. The vehicle 1 is mounted with a communication device 14 to communicate with the server 20.

In the embodiment of the present disclosure, the vehicle drive unit 2 is constituted of an electric motor driven by a secondary battery or an electric motor driven by a fuel cell. The drive wheel is driven and controlled by the electric motors in accordance with an output signal of the electronic control unit 5. In addition, the braking device 3 performs braking control of the vehicle 1 in accordance with an output signal of the electronic control unit 5. The steering device 4 performs steering control of the vehicle 1 in accordance with an output signal of the electronic control unit 5.

Figure 2:
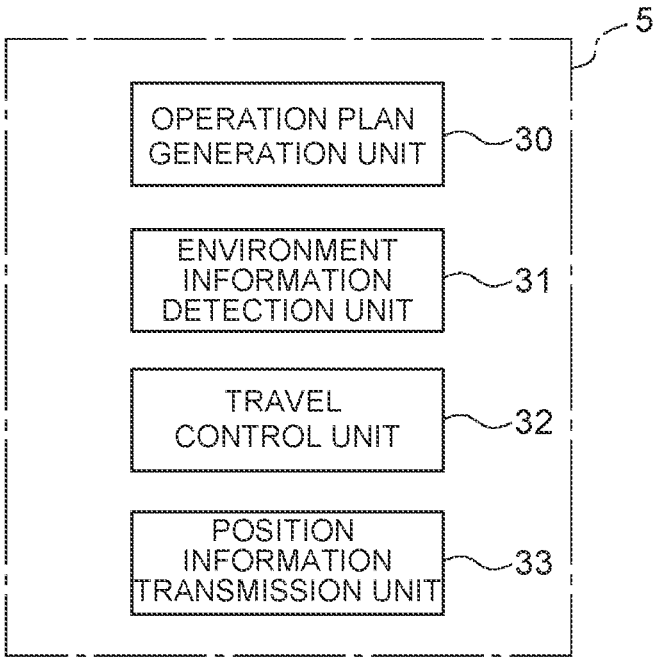
FIG. 2 is a functional block diagram for autonomous traveling of the vehicle.

FIG. 2 is a functional block diagram for autonomous traveling of the vehicle 1. As shown in FIG. 2, in the embodiment of the present disclosure, the vehicle 1 includes an operation plan generation unit 30, an environment information detection unit 31, a travel control unit 32, and a position information transmission unit 33. Upon reception of an operation command from the server 20, the operation plan generation unit 30 generates an operation plan including a travel route, travel speeds, stop positions, and the like, of the vehicle 1 based on the operation command. The environment information detection unit 31 uses the environment information sensor 11 to detect the environment information required for autonomous traveling of the vehicle 1. For example, the environment information detection unit 31 detects the number and position of lanes, the number and position of other mobile objects present around the own vehicle 1, the number and position of obstacles present around the own vehicle 1 (for example, pedestrians, bicycles, structures, buildings, and the like), the structure of roads, and road signs.

The travel control unit 32 performs travel control for autonomous traveling of the vehicle 1 based on the operation plan generated by the operation plan generation unit 30, the environment information detected by the environment information detection unit 31, map data stored in the map data storage device 12, and the current position of the vehicle 1 detected by the position information sensor 10. This allows the vehicle 1 to travel autonomously along a set travel route while avoiding contact with other mobile objects or obstacles. The position information transmission unit 33 transmits information about the current position of the vehicle 1 detected by the position information sensor 10 to the server 20 via the communication device 14. Note that the operation plan generation unit 30, the environment information detection unit 31, the travel control unit 32, and the position information transmission unit 33 are formed in the electronic control unit 5 of the vehicle 1.

Figure 3:
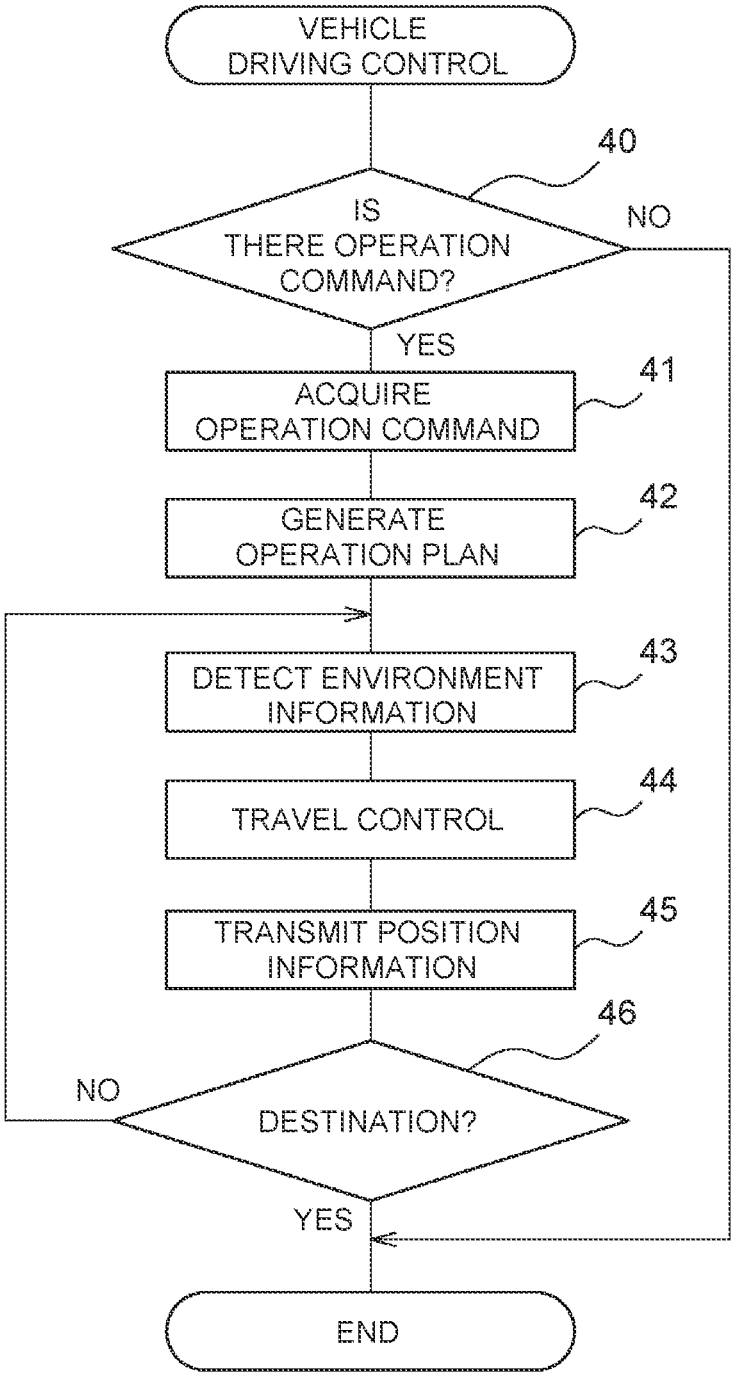
FIG. 3 is a flowchart for performing driving control of the vehicle.

FIG. 3 shows a vehicle driving control routine executed in the electronic control unit 5 mounted in the vehicle 1 for autonomous traveling of the vehicle. The routine is executed by interruption at constant time intervals.

With reference to FIG. 3, first in step 40, the electronic control unit 5 determines whether or not an operation command is received from the server 20. When it is determined that the operation command is not received from the server 20, the electronic control unit 5 ends the processing cycle. On the contrary, when it is determined that the operation command is received from the server 20, the processing cycle proceeds to step 41 to acquire the operation command. Then, in step 42, the electronic control unit 5 generates an operation plan including a travel route, travel speeds, stop positions, and the like, of the vehicle 1 based on the operation command.

Then, in step 43, the electronic control unit 5 detects environment information required for autonomous traveling of the vehicle 1. Then, in step 44, the electronic control unit 5 performs travel control for autonomous traveling of the vehicle 1. This allows the vehicle 1 to travel autonomously along a set travel route while avoiding contact with other mobile objects or obstacles. Then, in step 45, the electronic control unit 5 transmits information about the current position of the vehicle 1 to the server 20. Then, in step 46, the electronic control unit 5 determines whether or not the vehicle 1 has reached a destination set by the operation command. In this case, in the embodiment of the present disclosure, it is determined whether or not a loop bus has reached a set destination after making a loop trip for a set number of times. When the electronic control unit 5 determines that the vehicle 1 has not yet reached the destination, i.e., when the electronic control unit 5 determines that the loop bus has not yet reached the destination after making a loop trip for the set number of times in the embodiment of the present disclosure, the processing cycle returns to step 43 to continue autonomous traveling control of the vehicle 1. When the electronic control unit 5 determines that the vehicle 1 has reached the destination, i.e., when the electronic control unit 5 determines that the loop bus has reached the destination after making a loop trip for the set number of times in the embodiment of the present disclosure, the processing cycle is ended.

In the embodiment according to the present disclosure, the vehicle 1 is constituted of a loop bus configured to travel autonomously along a preset travel route within a preset area. Thus, the loop bus configured to be able to travel autonomously includes various sensors that can detect another vehicle traveling around the loop bus and the state around the other vehicle. Accordingly, from another perspective, the loop bus can detect another vehicle and the state around the other vehicle along the travel route of the loop bus over a wide range with these sensors. Therefore, in the embodiment of the present disclosure, the sensors are used to detect another vehicle and the state around the other vehicle, and controls a traffic signal that is installed in an advance direction of the other vehicle depending on the traveling state of the other vehicle.

Figure 4A:
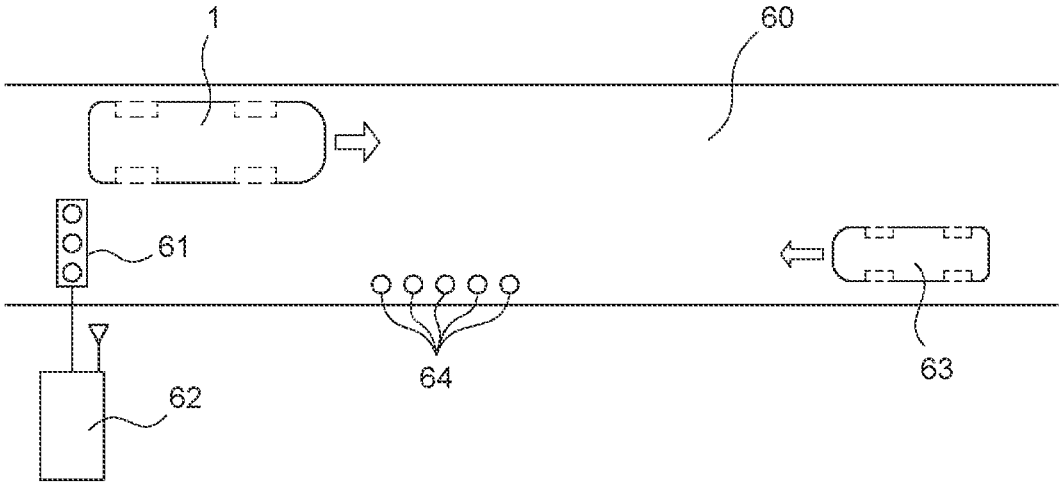
FIG. 4A graphically shows vehicles traveling on a road and a traffic signal.

Now, some specific examples of controlling a traffic signal installed in the advance direction of another vehicle depending on the traveling state of the other vehicle will be described in order. FIGS. 4A to 9 show a first example of the present disclosure. With reference to FIG. 4A, reference numeral 60 denotes a road, reference numeral 61 denotes a traffic signal, and reference numeral 62 denotes a traffic signal control device. In the embodiment of the present disclosure, the own vehicle 1 can communicate with the traffic signal control device 62. FIG. 4A shows the own vehicle 1 traveling in an arrow direction, and another vehicle 63 traveling in another arrow direction on the opposite lane as viewed from the own vehicle 1. In the following description, component members identical to those shown in FIG. 4A are denoted by identical reference signs used in FIG. 4A to omit a description thereof.

FIG. 4A shows the case where, for example, there are pedestrians 64, such as children in a row on the way to a kindergarten or a school, ahead in the advance direction of the other vehicle 63. In this case, for the safety of the pedestrians 64, it is desirable that the other vehicle 63 travels beside the pedestrians 64 at lower speeds, which requires the other vehicle 63 to decelerate. Accordingly, in the example shown in FIG. 4A, when there are the pedestrians 64 ahead in the advance direction of the other vehicle 63, a signal of the traffic signal 61 installed ahead in the advance direction of the other vehicle 63 is switched, when the signal is other than a red signal, from the signal other than the red signal to the red signal, and the time of the red signal is prolonged when the signal of the traffic signal 61 is the red signal, so as to decelerate the other vehicle 63.

Figure 4B:
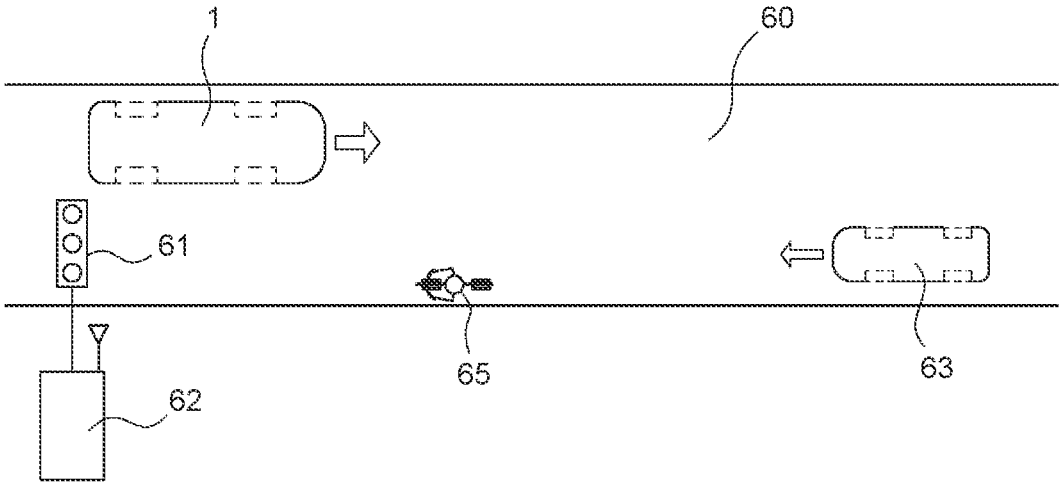
FIG. 4B graphically shows vehicles traveling on a road and a traffic signal.

Meanwhile, FIG. 4B shows the case where there is a cyclist 65 traveling by a bicycle ahead in the advance direction of the other vehicle 63. In this case, for the safety of the cyclist 65, it is also desirable that the other vehicle 63 travels beside the cyclist 65 at lower speeds, which requires the other vehicle 63 to decelerate. Accordingly, in the first example of the present disclosure, when there are other mobile objects, such as the pedestrians 64 or the cyclist 65 ahead in the advance direction of the other vehicle 63, the signal of the traffic signal 61 installed ahead in the advance direction of the other vehicle 63 is switched, when the signal is other than the red signal, from the signal other than the red signal to the red signal, and the time of red signal is prolonged when the signal of the traffic signal 61 is the red signal so as to decelerate the other vehicle 63.

Incidentally, in order to decelerate the other vehicle 63 by switching the signal of the traffic signal 61 installed ahead in the advance direction of the other vehicle 63 to the red signal or by prolonging the time of the red signal, a distance between the other vehicle 63 and the traffic signal 61 needs to be equal to or less than a certain distance between about 100 meters and about 200 meters. Accordingly, in the first example of the present disclosure, when there are other mobile objects, such as the pedestrians 64 or the cyclist 65 ahead in the advance direction of the other vehicle 63, and when the travel distance between the other vehicle 63 and the traffic signal 61 is equal to or less than a set distance SX set in advance, traffic signal control is performed to switch the signal of the traffic signal 61, installed ahead in the advance direction of the other vehicle 63, to the red signal or to prolong the time of the red signal. When there are other mobile objects, such as the pedestrians 64 or the cyclist 65 ahead in the advance direction of the other vehicle 63, and the travel distance between the other vehicle 63 and the traffic signal 61 is equal to or more than the set distance SX, the traffic signal control to switch the signal of the traffic signal 61, installed ahead in the advance direction of the other vehicle 63, to the red signal or to prolong the time of the red signal is not performed.

Figure 5A:
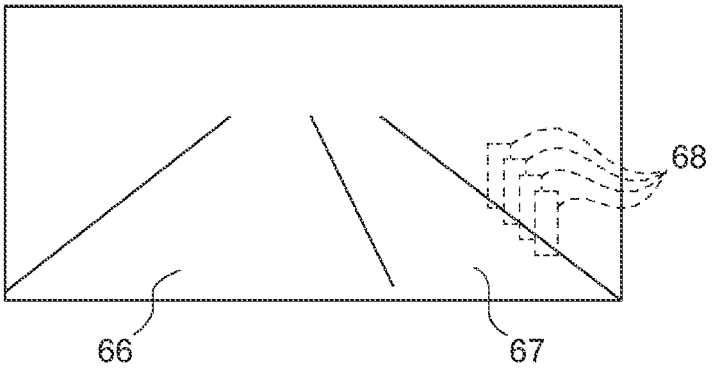
FIG. 5A graphically shows an image of an in-vehicle camera.

In the embodiment of the present disclosure, the presence of the other vehicle 63 and other mobile objects, such as the pedestrians 64, or the cyclist 65, is detected by an object detection method using a camera that is one of the environment information sensors 11 to photograph an area in front of the vehicle 1. The object detection method will be briefly described by taking as an example the case of using well-known regions with CNN features (R-CNN) involving convolutional neural networks, for example. FIG. 5A graphically shows an image photographed by the camera. As shown in FIG. 5A, the image photographed by the camera includes a travel lane 66 of the vehicle 1, an opposite lane 67, and bounding boxes 68 representing object area candidate. In the example shown in FIG. 5A, the bounding boxes 68 encircling the pedestrians 64 are illustrated. Respective images in the bounding boxes 68 serving as the object area candidates are input into a learned convolutional neural network CNN. As a result, vectors referred to as CNN features corresponding to the respective images are generated. The CNN features generated in the convoluted neural network CNN is input into a classifier that is constituted of a support vector machine. As a result, the class of objects (for example, pedestrian) within the bounding boxes serving as the object area candidates are identified. In other words, the objects are identified. Of course, as the object detection method, Fast R-CNN and Faster R-CNN, which are advanced forms of R-CNN, YOLO, or SSD can also be used.

Figure 5B:
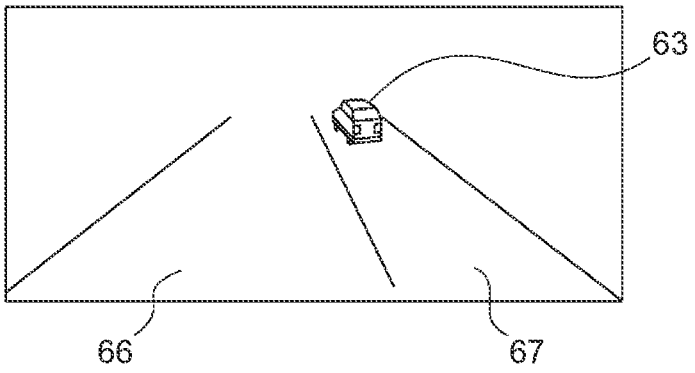
FIG. 5B graphically shows an image of an in-vehicle camera.

FIG. 5A shows the time when the presence of the pedestrians 64 are recognized after the vehicle 1 has passed the traffic signal 61. FIG. 5B shows the time when the presence of another vehicle 63 (bounding box omitted) is recognized after the time of FIG. 5A. In the embodiment of the present disclosure, a stereo camera that photographs a forward area is provided as one of the environment information sensors 11. When the presence of the other vehicle 63 is recognized, a distance to the other vehicle 63 is detected with the stereo camera. Further in this case, a travel distance of the vehicle 1 after the vehicle 1 has passed the traffic signal 61 is calculated. When a sum of the calculated travel distance and the distance to the other vehicle 63, that is, a distance between the traffic signal 61 and the other vehicle 63, is equal to or less than the set distance SX, the signal of the traffic signal 61, installed ahead in the advance direction of the other vehicle 63, is switched from signals other than the red signal to the red signal, or the time of the red signal is prolonged.

Figure 6:
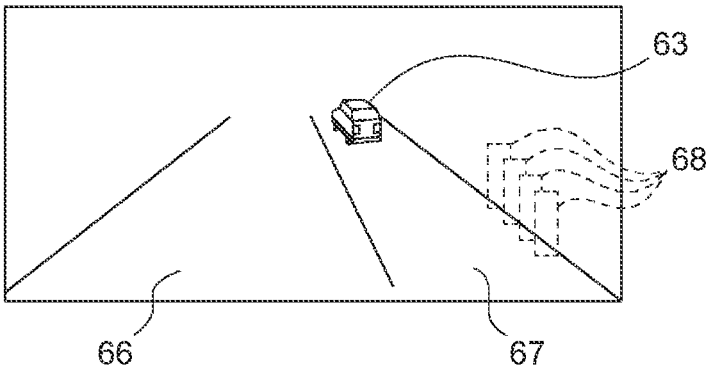
FIG. 6 graphically shows an image of the in-vehicle camera.

Meanwhile, FIG. 6 shows the time when the presence of the pedestrians 64 and the presence of another vehicle 63 (bounding box omitted) are recognized at the same time after the vehicle 1 has passed the traffic signal 61. Also in this case, the distance of the other vehicle 63 is detected with the stereo camera, and the travel distance of the own vehicle 1 after the vehicle 1 has passed the traffic signal 61 is calculated. When the sum of the calculated travel distance and the distance to the other vehicle 63, that is, the distance between the traffic signal 61 and the other vehicle 63, is equal to or less than the set distance SX, the signal of the traffic signal 61, installed ahead in the advance direction of the other vehicle 63, is switched from signals other than the red signal to the red signal, or the time of the red signal is prolonged. It is also possible to recognize the presence of the other vehicle 63 and other mobile objects, such as the pedestrians 64 or the cyclist 65, using the LIDAR, and it is also possible to detect the distance to the other vehicle 63 using the LIDAR or the radar.

Figure 7:
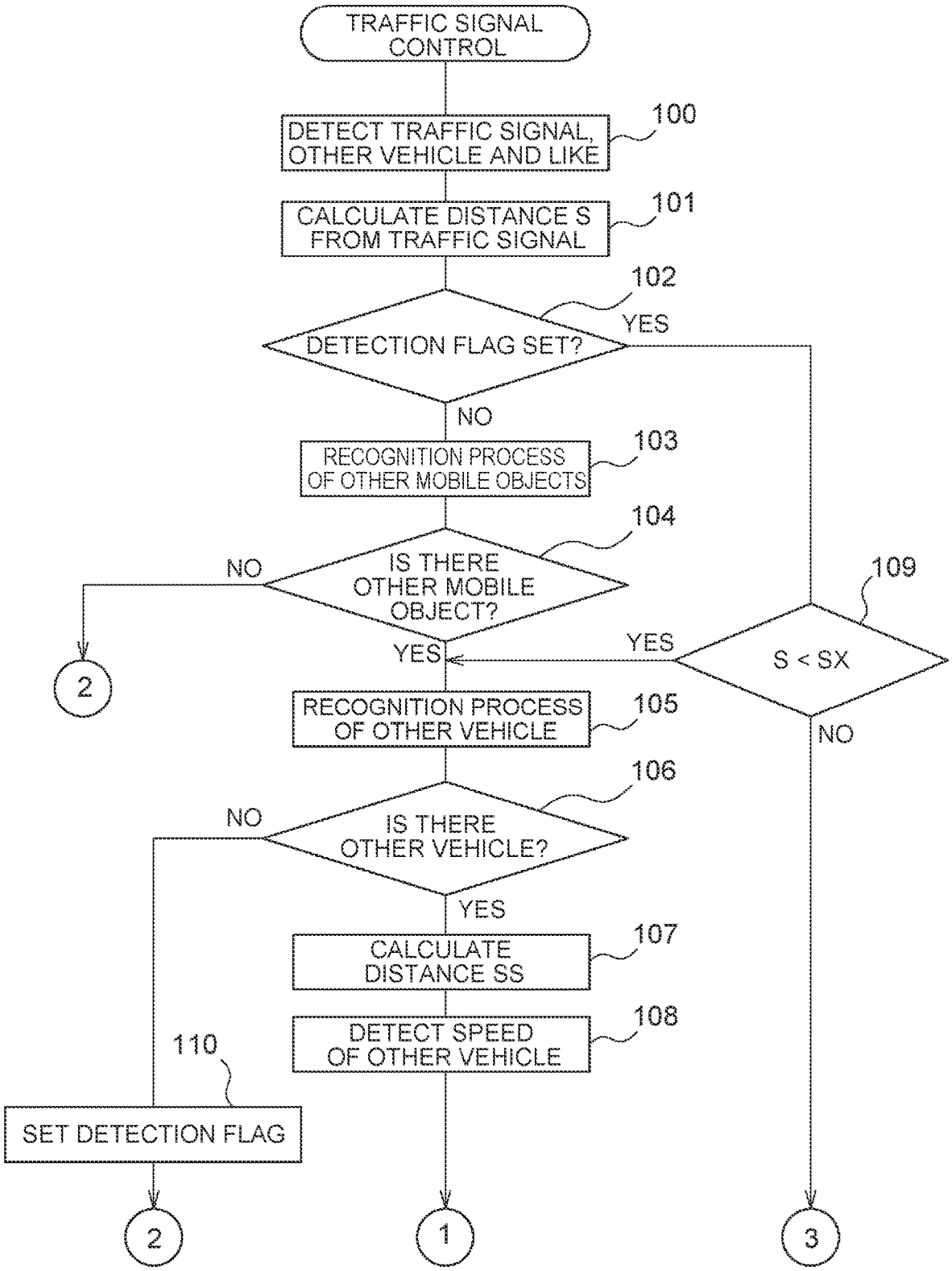
FIG. 7 is a flowchart for performing traffic signal control.
Figure 8:
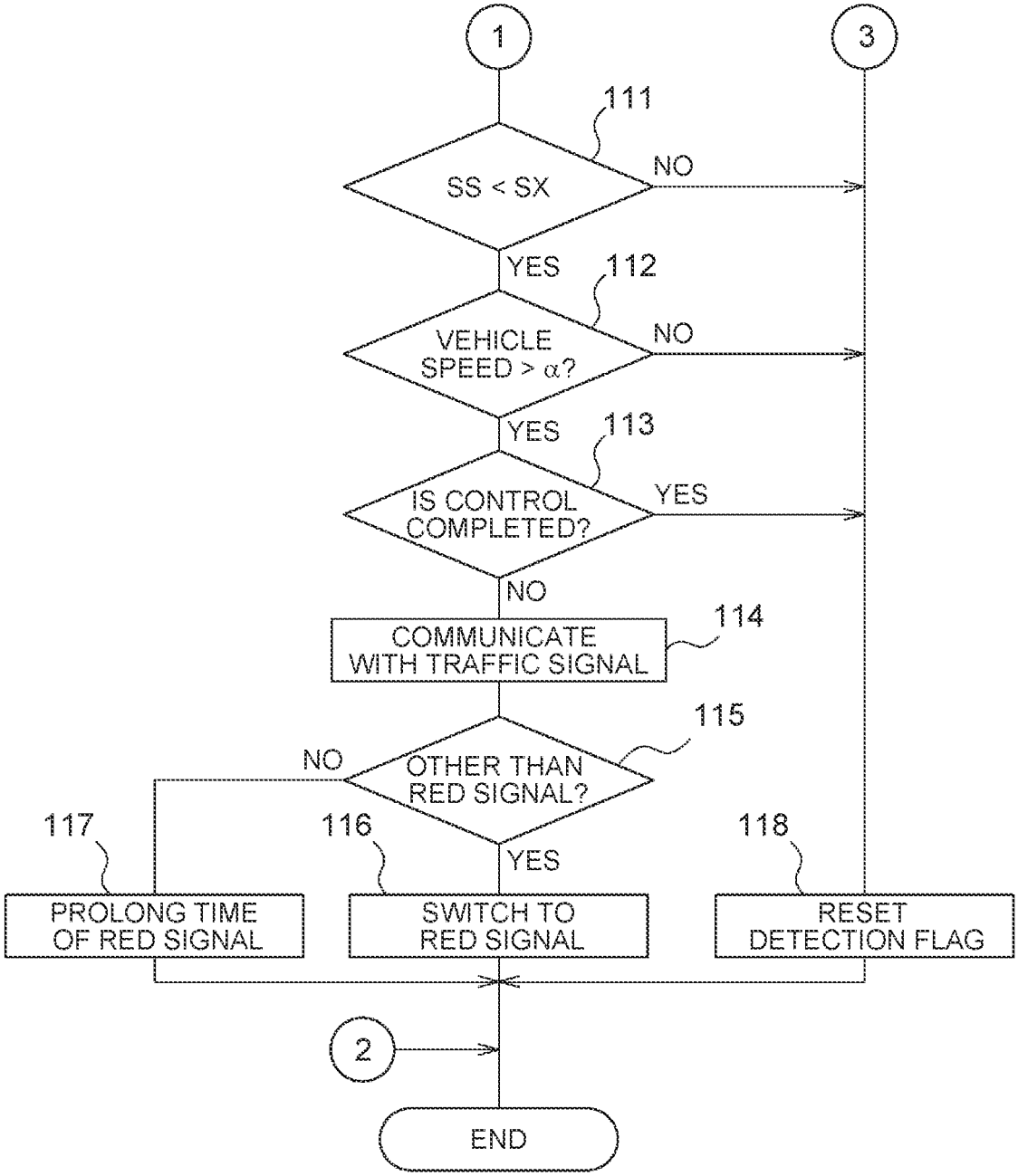
FIG. 8 is a flowchart for performing traffic signal control.

FIGS. 7 and 8 show a traffic signal control routine executed in the electronic control unit 5 of the own vehicle 1 in order to implement the first example according to the present disclosure. The routine is executed by interruption at constant time intervals.

With reference to FIGS. 7 and 8, first in step 100, the electronic control unit 5 detects the traffic signal 61 installed on a travel road of the own vehicle 1, the other vehicle 63, and another mobile object with the camera that photographs a forward area, and the stereo camera that photographs the forward area. Next, in step 101, the electronic control unit 5 calculates the travel distance of the own vehicle 1 after the own vehicle 1 has passed the traffic signal 61, that is, a distance S from the traffic signal 61. Then, in step 102, the electronic control unit 5 determines whether or not a detection flag is set, the detection flag being set when the presence of the other vehicle 63 is not recognized and only the presence of another mobile object is recognized. When the detection flag is not set, the processing cycle proceeds to step 103 to perform a recognition process of the other mobile object based on the images photographed by the cameras.

Next, in step 104, based on the recognition process, the electronic control unit 5 determines whether or not there is another mobile object, for example, whether or not there is another mobile object on the opposite lane 67 or beside the opposite lane 67. When the electronic control unit 5 determines that the other mobile object is not present, the electronic control unit 5 ends the process cycle. Contrary to this, when it is determined that the other mobile object is present, the processing cycle proceeds to step 105 to perform recognition process of the other vehicle 63 based on the images photographed by the cameras. Next, in step 106, the electronic control unit 5 determines whether or not there is another vehicle 63, for example, whether or not there is another vehicle 63 traveling on the opposite lane 67. When the electronic control unit 5 determines that the other vehicle 63 is not present, the processing cycle proceeds to step 110 to set the detection flag that is set when the presence of the other vehicle 63 is not recognized and only the presence of another mobile object is recognized. Then, the electronic control unit 5 ends the processing cycle.

In contrast, when the electronic control unit 5 determines in step 106 that the other vehicle 63 is present, that is, when the presence of the other mobile object and the presence of the other vehicle 63 are simultaneously recognized, the processing cycle proceeds to step 107 to calculate a distance SS between the traffic signal 61 and the other vehicle 63 from the sum of the distance to the other vehicle 63 calculated based on the image photographed by the stereo camera and the distance S from the traffic signal 61 calculated in step 101. Then, in step 108, the electronic control unit 5 calculates the speed of the other vehicle 63 based on the image photographed by the stereo camera. Then, in step 111, the electronic control unit 5 determines whether or not the distance SS between the traffic signal 61 and the other vehicle 63 is equal to or less than the set distance SX. When the distance SS between the traffic signal 61 and the other vehicle 63 is equal to or less than the set distance SX, the processing cycle proceeds to step 112 to determine whether or not the speed of the other vehicle 63 is equal to or more than a safe speed a. The safe speed a is set in advance to 20 km/h, for example.

When the speed of the other vehicle 63 is equal to or more than the safe speed a, the processing cycle proceeds to step 113 to determine whether or not control of the traffic signal 61 is completed. When the control of the traffic signal 61 is not yet completed, the processing cycle proceeds to step 114 to perform communication between the own vehicle 1 and the traffic signal 61. Then, in step 115, the electronic control unit 5 determines whether or not the signal of the traffic signal 61 is other than a red signal. When the signal of the traffic signal 61 is other than the red signal, the processing cycle proceeds to step 116 to switch the signal of the traffic signal 61 from the signal other than the red signal to the red signal. On the contrary, when the signal of the traffic signal 61 is the red signal, the processing cycle proceeds to step 117 to prolong the time when the signal of the traffic signal 61 is the red signal.

Meanwhile, when the detection flag is set, the processing cycle shifts from step 102 to step 109 to determine whether or not the distance S from the traffic signal 61 calculated in step 101 is equal to or less than the set distance SX. When the distance S from the traffic signal 61 is equal to or less than the set distance SX, the processing cycle proceeds to step 105 to perform the recognition process of the other vehicle 63 based on the images photographed by the cameras. Then, in step 106, the electronic control unit 5 determines whether or not there is another vehicle 63, for example, whether or not there is another vehicle 63 traveling on the opposite lane 67. In this case, when the electronic control unit 5 determines that there is the other vehicle 63, that is, when the presence of the other vehicle 63 is recognized some time after the presence of another mobile object is recognized, the routine in and after step 107 is executed.

In other words, in this case, when the electronic control unit 5 determines that the distance SS between the traffic signal 61 and the other vehicle 63 is equal to or less than the set distance SX, the speed of the other vehicle 63 is equal to or more than the safe speed a, and the control of the traffic signal 61 is not yet completed, the electronic control unit 5 switches the signal of the traffic signal 61, when the signal is other than the red signal, from the signal other than the red signal to the red signal, and prolongs the time of the red signal when the signal of the traffic signal 61 is the red signal in steps 114 to 117.

Meanwhile, when the electronic control unit 5 determines in step 109 that the distance S from the traffic signal 61 calculated in step 101 exceeds the set distance SX, the processing cycle proceeds to step 118 to reset the detection flag. Then, the electronic control unit 5 ends the processing cycle. In this case, the control process of the traffic signal 61 is not performed. Furthermore, when the electronic control unit 5 determines in step 111 that the distance SS between the traffic signal 61 and the other vehicle 63 is not equal to or less than the set distance SX, or when the electronic control unit 5 determines in step 112 that the speed of the other vehicle 63 is not equal to or more than the safe speed a, or when the electronic control unit 5 determines in step 113 that the control of the traffic signal 61 is completed, the processing cycle proceeds to step 118 to reset the detection flag. Also in this case, the control process of the traffic signal 61 is not performed.

Figure 9:
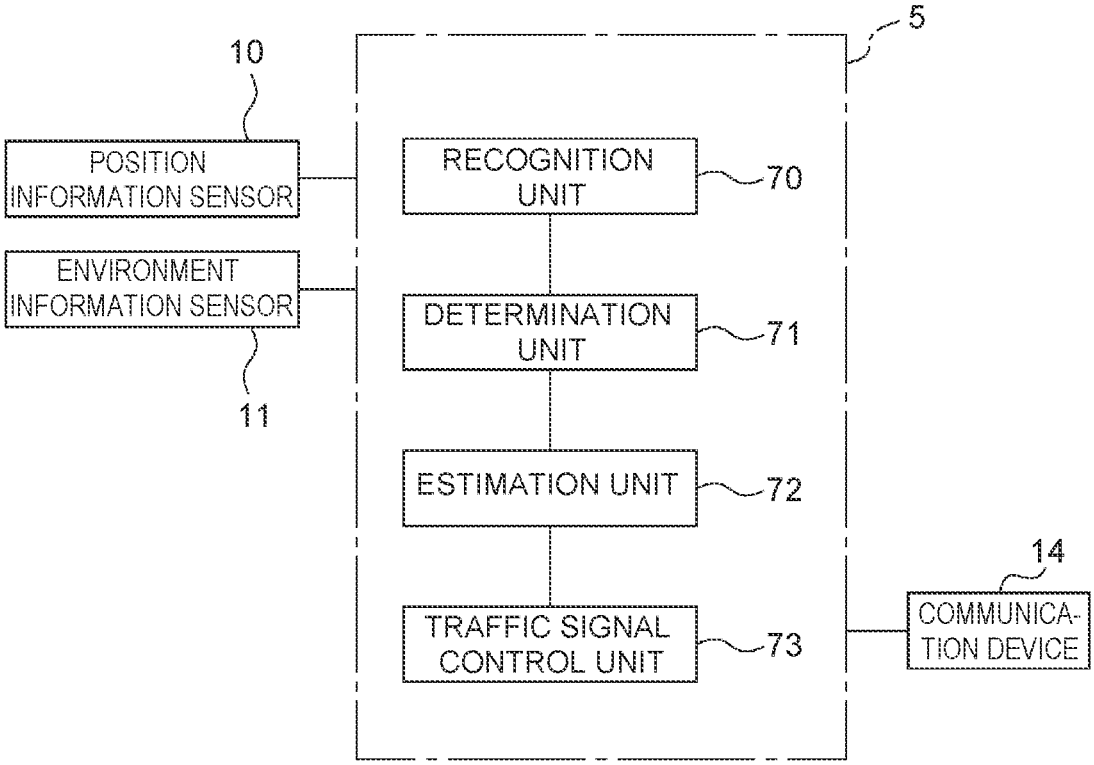
FIG. 9 is a function block diagram of an embodiment according to the present disclosure.

FIG. 9 is a function block diagram showing the first example of the present disclosure. As shown in FIG. 9, in the first example of the present disclosure, the vehicle includes sensors 10, 11, a recognition unit 70, a determination unit 71, an estimation unit 72, a communication device 14, and a traffic signal control unit 73. The sensors 10, 11 detect a traffic signal installed in a travel route of the own vehicle, another vehicle traveling around the own vehicle, and another mobile object around the own vehicle. The recognition unit 70 recognizes the presence of the traffic signal, the other vehicle, and the other mobile object based on the detection result of the sensors 10, 11. The determination unit 71 determines, after the recognition unit 70 recognizes that the own vehicle has passed the traffic signal, whether or not there are the other mobile object moving toward the traffic signal and the other vehicle moving beside the other mobile object toward the traffic signal. The estimation unit 72 estimates the traveling state of the other vehicle. The communication device 14 is a communication unit that communicates with the traffic signal. The traffic signal control unit 73 controls, when the determination unit 71 determines that there are the other mobile object moving toward the traffic signal and the other vehicle moving beside the other mobile object toward the traffic signal, the traffic signal based on the traveling state of the other vehicle estimated by the estimation unit 72.

In this case, in the embodiment of the present disclosure, when the determination unit 71 determined that there are the other mobile object moving toward the traffic signal and the other vehicle moving beside the other mobile object toward the traffic signal, the traffic signal control unit 73 switches the signal of the traffic signal, when the signal is other than the red signal, from the signal other than the red signal to the red signal based on the traveling state of the other vehicle estimated by the estimation unit 72, and prolongs the time of the red signal when the signal of the traffic signal is the red signal. In the embodiment of the present disclosure, when the determination unit 71 determines that there are the other mobile object moving toward the traffic signal and the other vehicle moving beside the other mobile object toward the traffic signal, and a distance between the traffic signal and the other vehicle is less than the set distance SX, the traffic signal control unit 73 switches the signal of the traffic signal, when the signal is other than the red signal, from the signal other than the red signal to the red signal based on the traveling state of the other vehicle estimated by the estimation unit 72, and prolongs the time of the red signal when the signal of the traffic signal is the red signal. In the embodiment of the present disclosure, when the other mobile object is a pedestrian or a cyclist, and the estimation unit 72 estimates that there is the pedestrian or the cyclist around the other vehicle and that the traveling state of the other vehicle is a safe speed exceeding state exceeding a preset safe speed, the traffic signal control unit 73 switches the signal of the traffic signal, when the signal is other than the red signal, from the signal other than the red signal to the red signal, and prolongs the time of the red signal when the signal of the traffic signal is the red signal.

Meanwhile, when the first example of the present disclosure is considered as a traffic signal control method, the method in the first example of the present disclosure includes: recognizing the presence of a traffic signal installed in a travel route of an own vehicle, another vehicle traveling around the own vehicle, and another mobile object around the own vehicle based on a detection result of the sensors 10, 11 that detect the traffic signal, the other vehicle, and the other mobile object; determining, after recognizing that the own vehicle has passed the traffic signal, whether or not there are the other mobile object moving toward the traffic signal and the other vehicle moving beside the other mobile object toward the traffic signal; estimating the traveling state of the other vehicle; communicating with the traffic signal; and controlling, when determining that there are the other mobile object moving toward the traffic signal and the other vehicle moving beside the other mobile object toward the traffic signal, the traffic signal based on the estimated traveling state of the other vehicle.

In the first example of the present disclosure, in order to execute the traffic signal control method, a program for causing a computer to perform functions is provided. The functions include: recognizing the presence of a traffic signal installed in a travel route of an own vehicle, another vehicle traveling around the own vehicle, and another mobile object around the own vehicle based on a detection result of the sensors 10, 11 that detect the traffic signal, the other vehicle, and the other mobile object; determining, after recognizing that the own vehicle has passed the traffic signal, whether or not there are the other mobile object moving toward the traffic signal and the other vehicle moving beside the other mobile object toward the traffic signal; estimating the traveling state of the other vehicle; communicating with the traffic signal; and controlling, when determining that there are the other mobile object moving toward the traffic signal and the other vehicle moving beside the other mobile object toward the traffic signal, the traffic signal based on the estimated traveling state of the other vehicle.

FIGS. 10A to 13 show a second example of the present disclosure. In the second example, the traffic signal 61 installed in the advance direction of another vehicle 63 is also controlled depending on the traveling state of the other vehicle 63. For example, in the second example, in order to decelerate the other vehicle 63 when the other vehicle 63 exceeds a legal speed limit, the signal of the traffic signal 61 installed ahead in the advance direction of the other vehicle 63 is switched, when the signal is other than the red signal, from the signal other than the red signal to the red signal, and the time of the red signal is prolonged when the signal of the traffic signal 61 is the red signal.

In the second example, the recognition process of the other vehicle 63 is also performed based on an image from a camera that photographs a forward area by using an object detection method similar to the object detection method used in the first example. On the other hand, in the second example, an advance route of the other vehicle 63 is predicted based on the image from the camera that photographs a forward area or a stereo camera that photographs the forward area. In the second example, the traffic signal 61 that the other vehicle 63 is expected to pass is identified based on information about the installation position of the traffic signal 61 and the predicted advance route of the other vehicle 63. For example, in the case shown in FIG. 10A, it is recognized that the other vehicle 63 is also traveling on the same road as the own vehicle 1 based on the image from the camera that photographs the forward area. Hence, it becomes possible to identify the traffic signal 61 that the other vehicle 63 is expected to pass based on the information about the installation position of traffic signal 61.

Figure 10A:
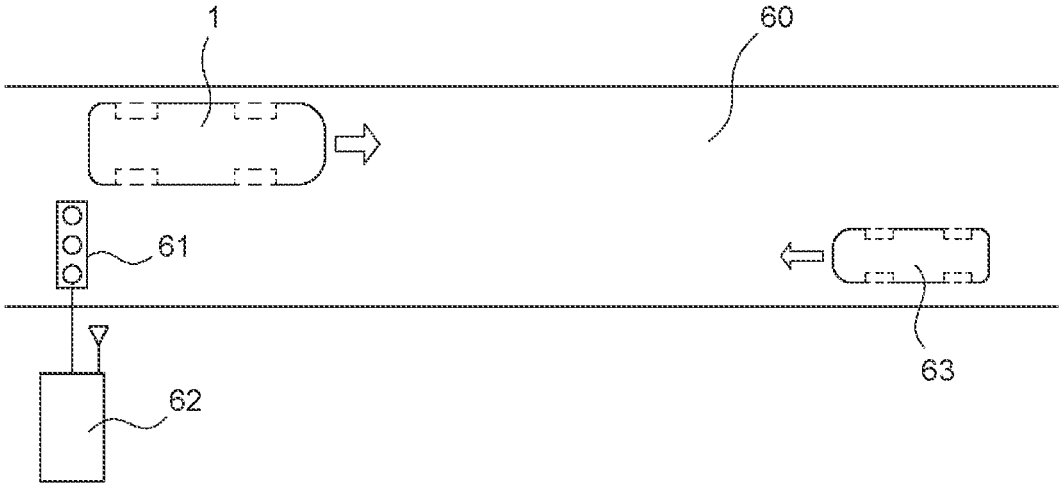
FIG. 10A graphically shows vehicles traveling on a road and a traffic signal.
Figure 10B:
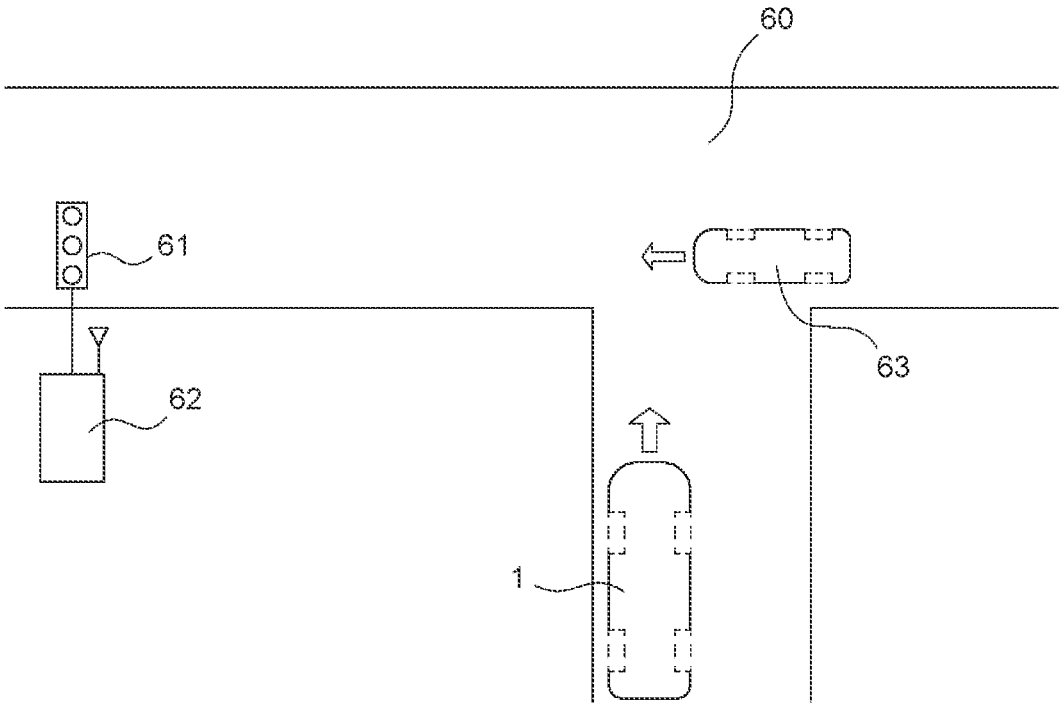
FIG. 10B graphically shows vehicles traveling on a road and a traffic signal.

In the case shown in FIG. 10B, it is possible to recognize that the other vehicle 63 is traveling on the road traversing in front of the own vehicle 1 based on the image of the camera that photographs the forward area. The road traversing in front of the vehicle 1 can be identified based on map data information about the roads. Therefore, in this case, it is also possible to identify the traffic signal 61 that the other vehicle 63 is expected to pass based on the information about the installation position of the traffic signal 61. In the second example, once the traffic signal 61 that the other vehicle 63 is expected to pass is identified, the identified traffic signal 61 is controlled based on the traveling state of the other vehicle 63. In this case, when, for example, the signal of the identified traffic signal 61 installed ahead in the advance direction of the other vehicle 63 is other than the red signal, the signal is switched from the signal other than the red signal to the red signal, and the time of the red signal is prolonged when the signal of the traffic signal 61 is the red signal so as to decelerate the other vehicle 63.

Incidentally, as described before, in order to decelerate the other vehicle 63 by switching the signal of the traffic signal 61, installed ahead in the advance direction of the other vehicle 63, from a signal other than the red signal to the red signal or by prolonging the time during which the traffic signal 61 is the red signal, the distance between the other vehicle 63 and the traffic signal 61 needs to be equal to or less than a certain distance SX set between about 100 meters and about 200 meters. In the second example, therefore, when the distance between the other vehicle 63 and the traffic signal 61 is equal to or less than the set distance SX, traffic signal control is also performed to switch the signal of the traffic signal 61, installed ahead in the advance direction of the other vehicle 63, to the red signal or to prolong the time of the red signal. When the distance between the other vehicle 63 and the traffic signal 61 is equal to or more than the set distance SX, the traffic signal control to switch the signal of traffic signal 61, installed ahead in the advance direction of the other vehicle 63, to the red signal or to prolong the time of the red signal is not performed.

Figure 11:
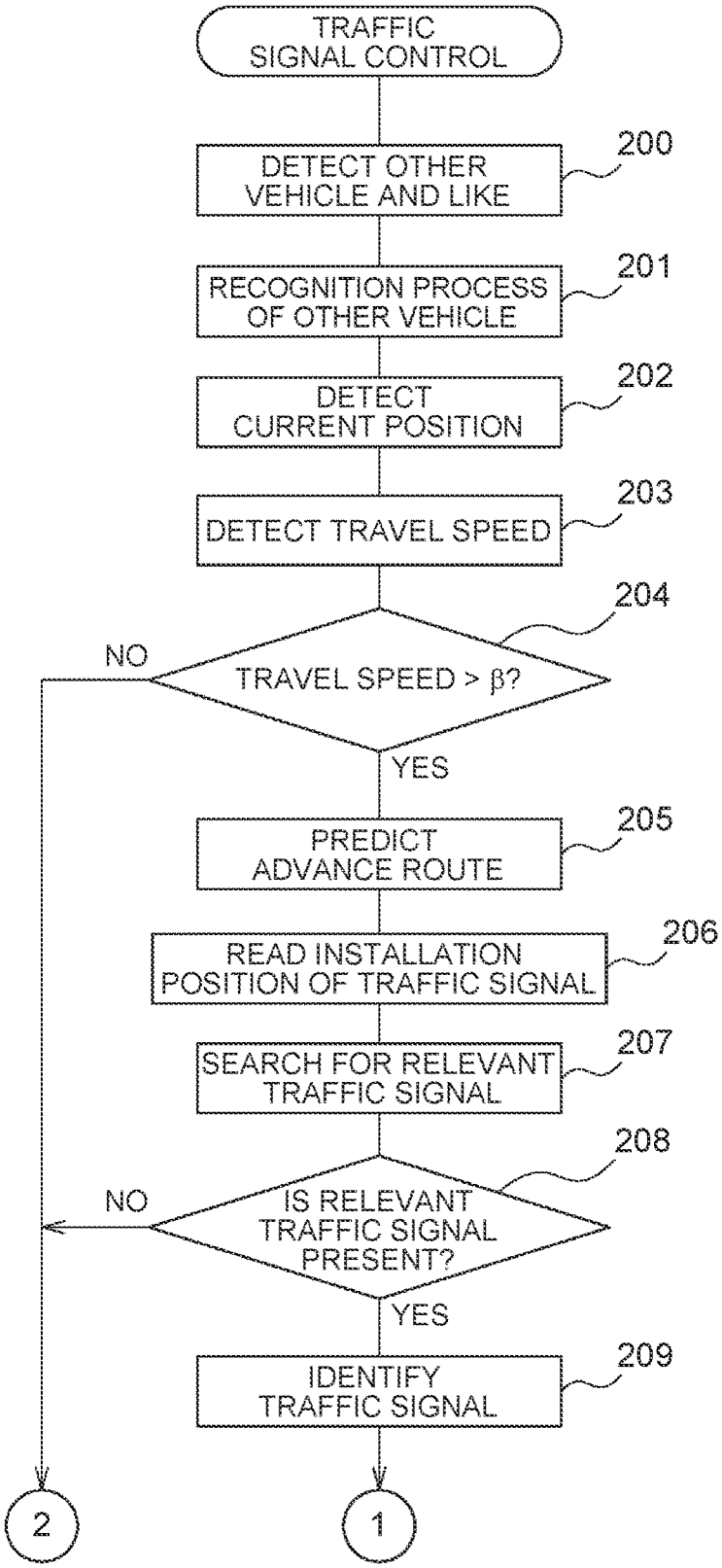
FIG. 11 is a flowchart for performing traffic signal control.
Figure 12:
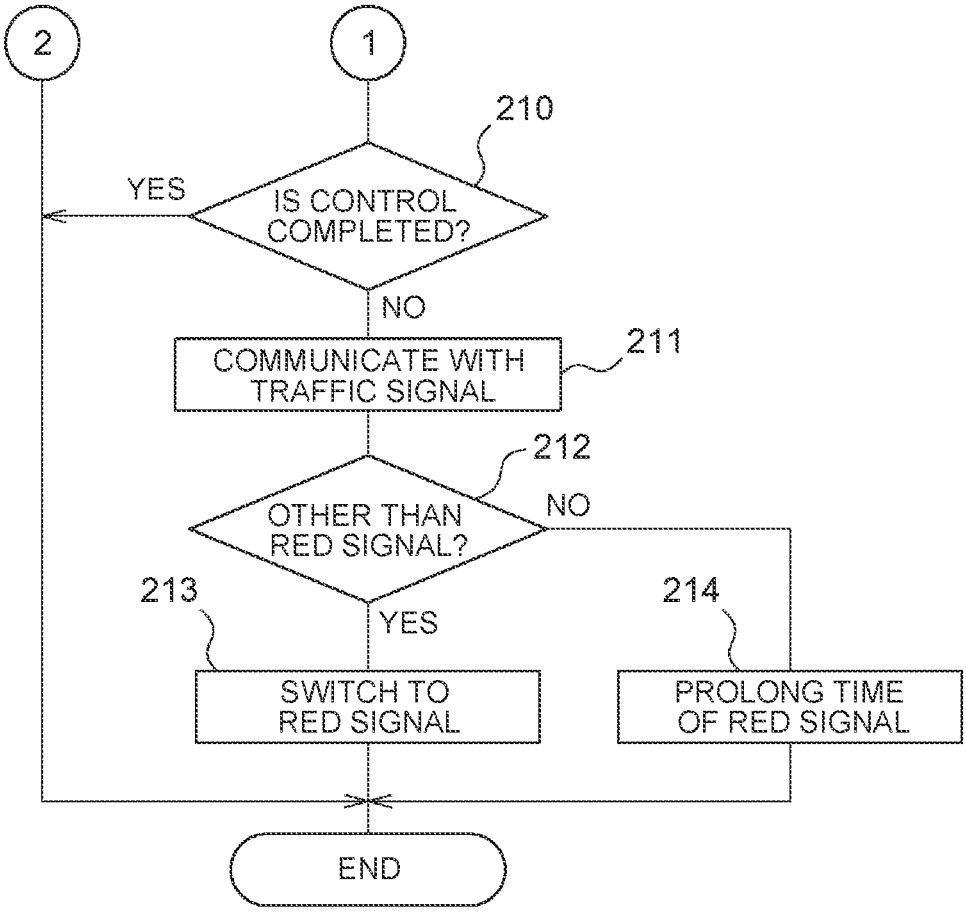
FIG. 12 is a flowchart for performing traffic signal control.

FIGS. 11 and 12 show a traffic signal control routine executed in the electronic control unit 5 of the own vehicle 1 in order to implement the second example according to the present disclosure. The routine is executed by interruption at constant time intervals. With reference to FIGS. 11 and 12, first in step 200, the electronic control unit 5 detects the other vehicle 63 traveling around the own vehicle 1, and the state around the other vehicle 63 with a camera that photographs a forward area, and a stereo camera that photographs the forward area. Then, in step 201, the electronic control unit 5 performs a recognition process of the other vehicle 63 based on the image photographed by the camera. When the recognition process of the other vehicle 63 is performed, the processing cycle proceeds to step 202 to detect the current position of the other vehicle 63. The current position of the other vehicle 63 is detected, for example, based on the position of the own vehicle 1 calculated based on the map data information about the roads and the information received by the global positioning system (GPS), and by using information on the image photographed by the camera or the stereo camera.

Then, in step 203, the electronic control unit 5 calculates the speed of the other vehicle 63 based on the image photographed by the camera or the stereo camera. Then, in step 204, the electronic control unit 5 determines whether or not the speed of the other vehicle 63 is equal to or more than a legal speed limit β. When the speed of the other vehicle 63 does not exceed the legal speed limit β, the electronic control unit 5 ends the processing cycle. On the contrary, when the speed of the other vehicle 63 is equal to or more than the legal speed limit β, the processing cycle proceeds to step 205 to predict the advance route of the other vehicle 63 based on the image photographed by the camera or the image photographed by the stereo camera. Then, in step 206, the electronic control unit 5 reads the installation position of the traffic signal. The installation position of the traffic signal is stored, for example, in the map data storage device 12. Then, in step 207, the electronic control unit 5 performs a search for a traffic signal that is located on the predicted advance route of the other vehicle 63 and that is located within a set distance SX from the current position of the other vehicle 63, i.e. a search for a relevant traffic signal.

When a relevant traffic signal is not found as a result of the search, the electronic control unit 5 determines in step 208 that a relevant traffic signal is not present, and ends the processing cycle. In contrast, when a relevant traffic signal is found, the electronic control unit 5 determines in step 208 that a relevant traffic signal is present. As a consequence, the processing cycle proceeds to step 209 to identify the relevant traffic signal, i.e., the traffic signal to be controlled. Then, the processing cycle proceeds to step 210 to determine whether or not the control of the identified traffic signal is competed. When the control of the identified traffic signal is not yet completed, the processing cycle proceeds to step 211 to perform communication between the own vehicle 1 and the identified traffic signal. Then, in step 212, the electronic control unit 5 determines whether or not the signal of the identified traffic signal is other than the red signal. When the signal of the identified traffic signal is other than the red signal, the processing cycle proceeds to step 213 to switch the signal of the identified traffic signal from the signal other than the red signal to the red signal. On the contrary, when the signal of the identified traffic signal is the red signal, the processing cycle proceeds to step 214 to prolong the time when the signal of the identified traffic signal is the red signal.

Figure 13:
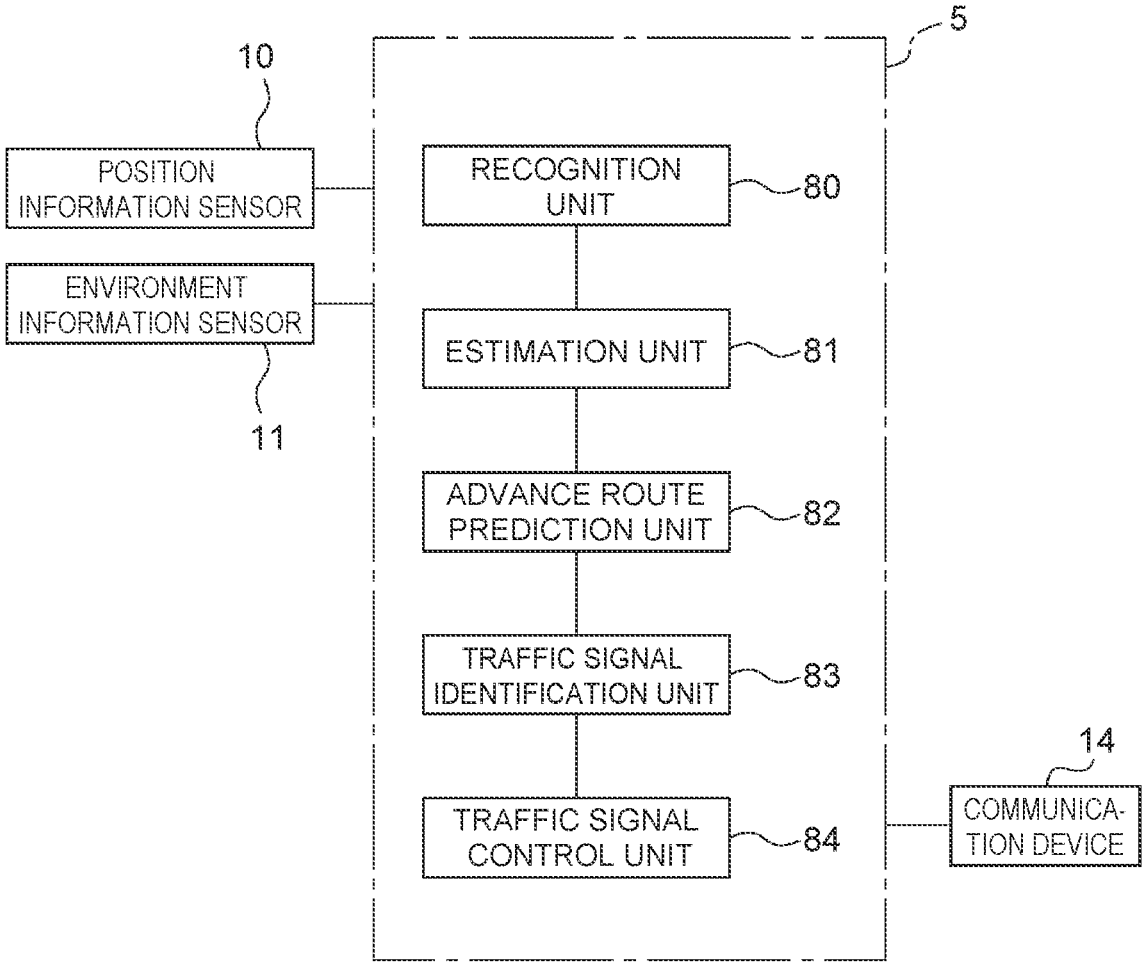
FIG. 13 is a function block diagram of an embodiment according to the present disclosure.

FIG. 13 is a function block diagram showing the second example of the present disclosure. As shown in FIG. 13, in the second example of the present disclosure, a vehicle includes sensors 10, 11, a recognition unit 80, an estimation unit 81, an advance route prediction unit 82, a traffic signal identification unit 83, a communication device 14, and a traffic signal control unit 84. The sensors 10, 11 detect another vehicle traveling around the own vehicle. The recognition unit 80 recognizes the presence of the other vehicle based on the detection result of the sensors. The estimation unit 81 estimates the current position and the traveling state of the other vehicle 63 recognized by the recognition unit 80 based on the detection result of the sensors 10, 11. The advance route prediction unit 82 predicts an advance route of the other vehicle 63 based on the current position and the traveling state of the other vehicle 63 estimated by the estimation unit 81. The traffic signal identification unit 83 identifies, based on the advance route of the other vehicle 63 predicted by the advance route prediction unit 82 and acquired installation positions of traffic signals, the traffic signal that the other vehicle 63 is expected to pass through. The communication device 14 is a communication unit that communicates with the identified traffic signal. The traffic signal control unit 84 controls the identified traffic signal based on the traveling state of the other vehicle 63 estimated by the estimation unit 81.

In this case, in the embodiment of the present disclosure, when the estimation unit 81 estimates that the traveling state of the other vehicle 63 is a speed limit exceeding state exceeding a legal speed limit, the traffic signal control unit 84 switches the signal of the identified traffic signal, when the signal is other than the red signal, from the signal other than the red signal to the red signal, and prolongs the time of the red signal when the signal of the identified traffic signal is the red signal. Moreover, in the embodiment of the present disclosure, when the estimation unit 81 estimates that the traveling state of the other vehicle 63 is a speed limit exceeding state exceeding a legal speed limit, and a distance between the identified traffic signal and the other vehicle 63 is equal to or less than a set distance SX, the traffic signal control unit 84 switches the signal of the identified traffic signal, when the signal is other than the red signal, from the signal other than the red signal to the red signal, and prolongs the time of the red signal when the signal of the identified traffic signal is the red signal.

Figure 14A:
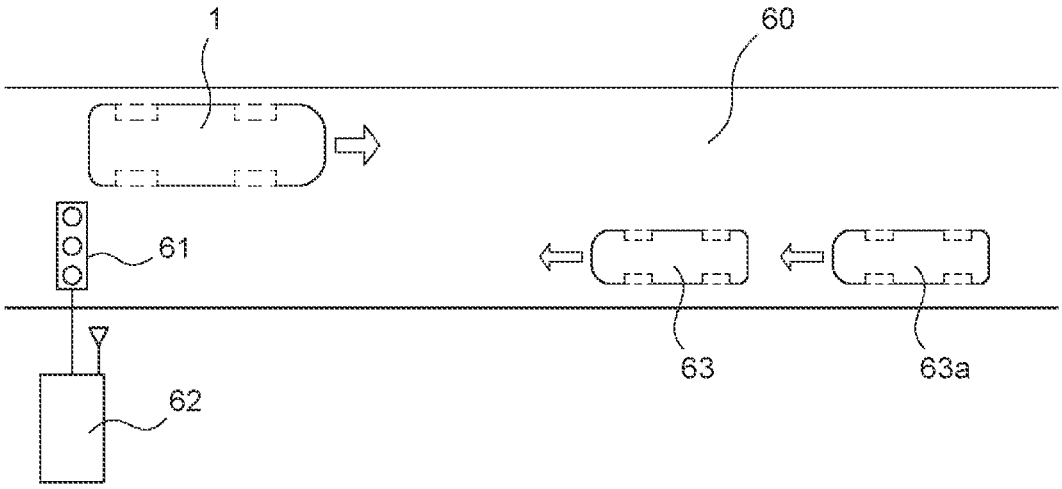
FIG. 14A graphically shows the vehicles traveling on a road and the traffic signal.

FIGS. 14A to 16 show a first modification of the second example according to the present disclosure. As shown in FIGS. 14A and 14B, the first modification of the second example relates to the case where another vehicle 63 is closely followed by still another vehicle 63*a*. In the first modification of the second example, the traffic signal 61 installed ahead in the advance direction of the other vehicle 63 is also controlled depending on the traveling state of the other vehicle 63. For example, in the first modification of the second example, when the other vehicle 63 exceeds the legal speed limit, the other vehicle 63 is decelerated by switching the signal of the traffic signal 61 installed ahead in the advance direction of the other vehicle 63, when the signal is other than the red signal, from the signal other than the red signal to the red signal, and prolonging the time of the red signal when the signal of the traffic signal 61 is the red signal.

Figure 14B:
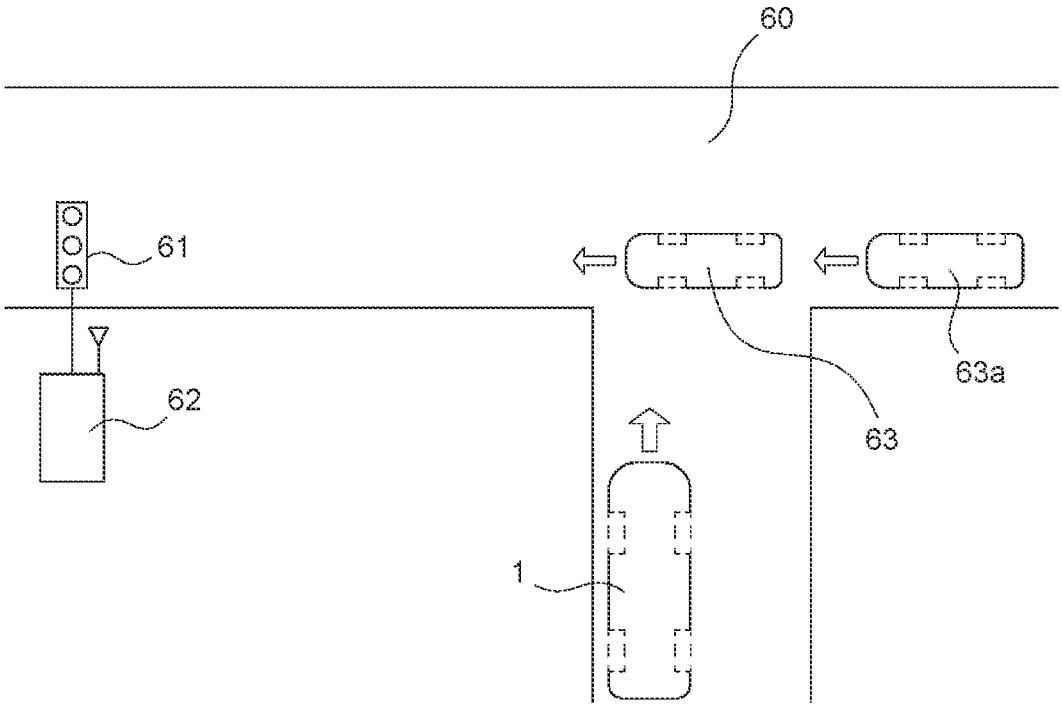
FIG. 14B graphically shows the vehicles traveling on a road and the traffic signal.

However, as shown in FIGS. 14A and 14B, when the other vehicle 63 is closely followed by still another vehicle 63*a* and in this state, the other vehicle 63 is decelerated by switching the signal of the traffic signal 61 installed ahead in the advance direction of the other vehicle 63 to the red signal, the following another vehicle 63*a* may collide with the preceding another vehicle 63. Accordingly, in the first modification of the second example, a notification device that notifies control of the traffic signal to around the own vehicle 1 is provided. Before the control of the traffic signal is performed, the notification device notifies that the signal of the identified traffic signal is switched from a signal other than the red signal to the red signal. In this case, as the notification device, a speaker or a display that is attached to the front surface of the own vehicle 1 or provided on the side or above the road may be used.

Figure 15:
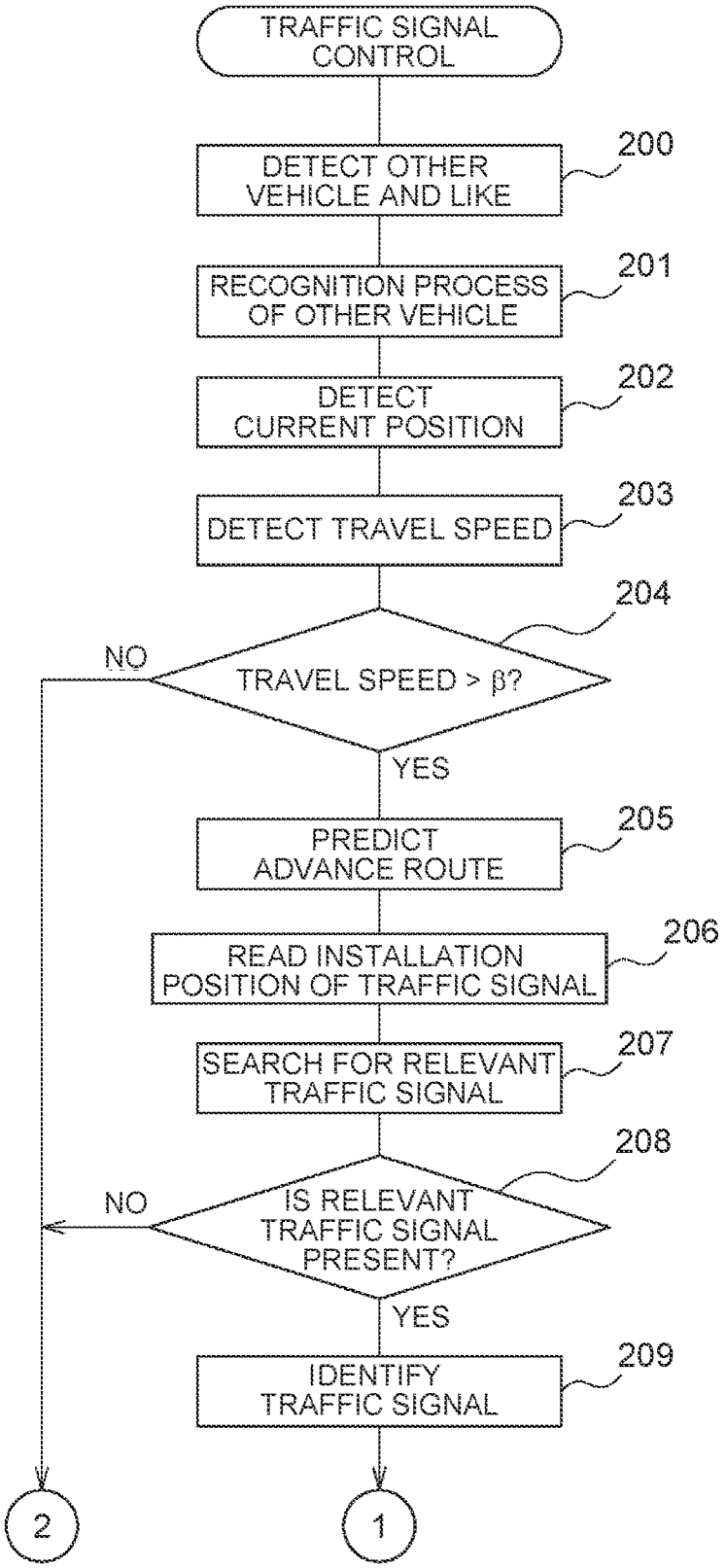
FIG. 15 is a flowchart for performing traffic signal control.
Figure 16:
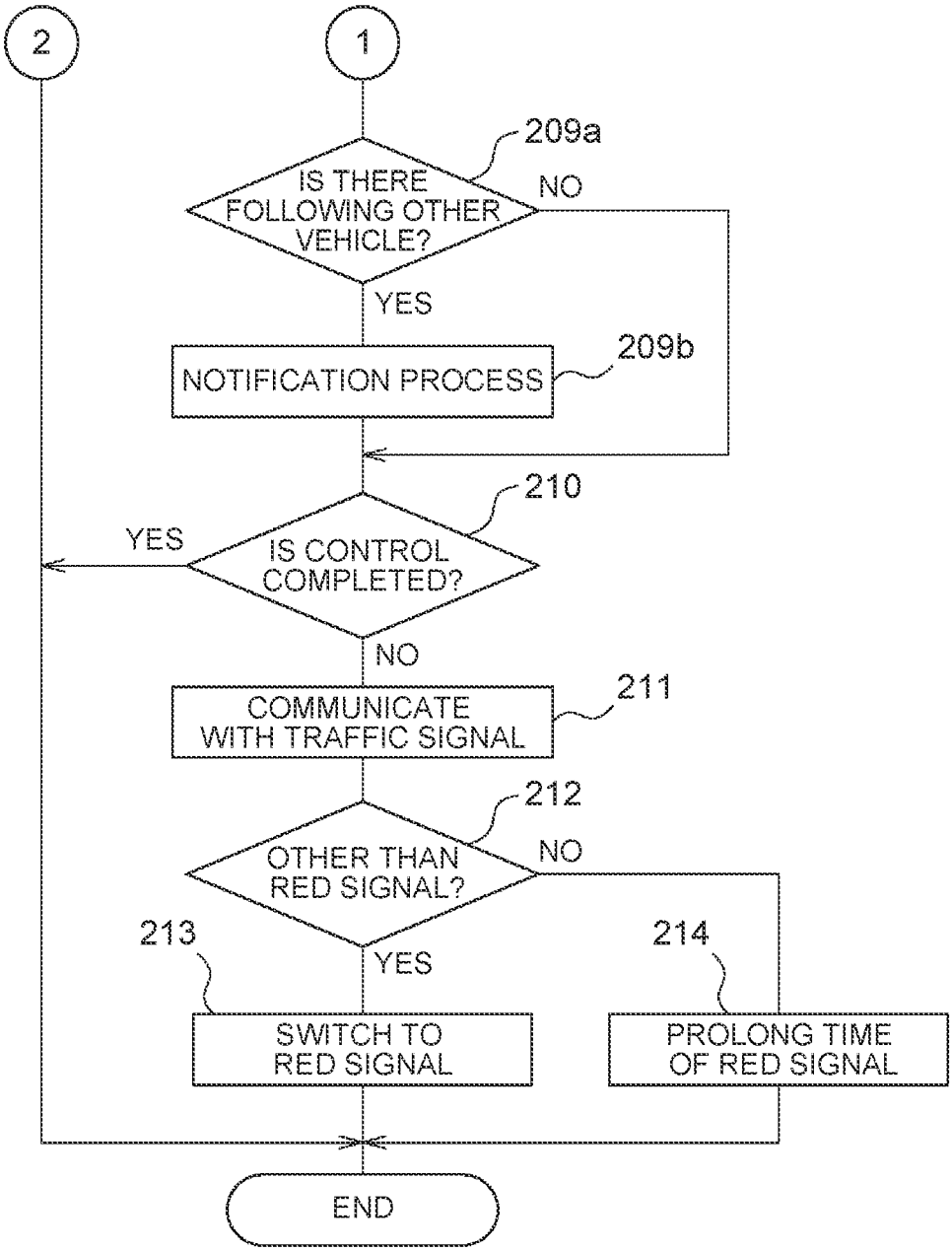
FIG. 16 is a flowchart for performing traffic signal control.

FIGS. 15 and 16 show a traffic signal control routine executed by interruption at constant time intervals in the electronic control unit 5 of the own vehicle 1 in order to implement the first modification of the second example. Note that steps 200 to 214 in the routine shown in FIGS. 15 and 16 are the same as steps 200 to 214 in the routine shown in FIGS. 11 and 12. The only difference between the routine shown in FIGS. 15 and 16 and the routine shown in FIGS. 11 and 12 is that two steps 209*a* and 209*b* are added between steps 209 and 210 in the routine shown in FIGS. 15 and 16. Therefore, for the routine shown in FIGS. 15 and 16, only the parts that are relevant to the two steps 209*a* and 209*b* will be discussed, and the rest will be omitted.

With reference to FIGS. 15 and 16, when the traffic signal to be controlled is identified in step 209, the processing cycle proceeds to step 209*a* to determine based on the image photographed by the camera whether or not there is following another vehicle 63*a*. When the electronic control unit 5 determines that the following another vehicle 63*a* is not present, the processing cycle proceeds to step 210 to determine whether or not the control of the identified traffic signal is competed. On the contrary, when the electronic control unit 5 determines that there is the following another vehicle 63*a*, the processing cycle proceeds to step 209*b* to notify by the speaker or the display that the signal of the traffic signal is switched from a signal other than the red signal to the red signal. Then, the processing cycle proceeds to step 210.

Figure 17:
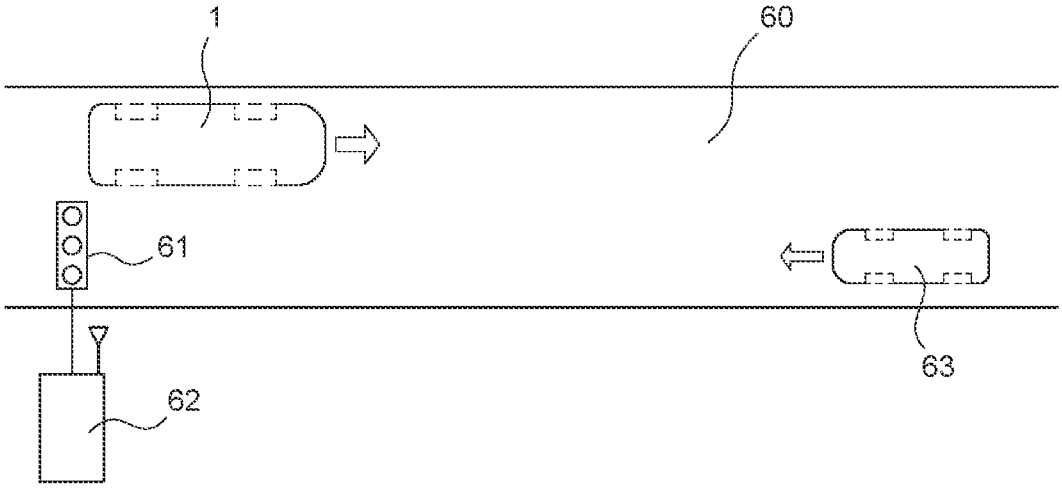
FIG. 17 graphically shows the vehicles traveling on a road and the traffic signal.
Figure 18:
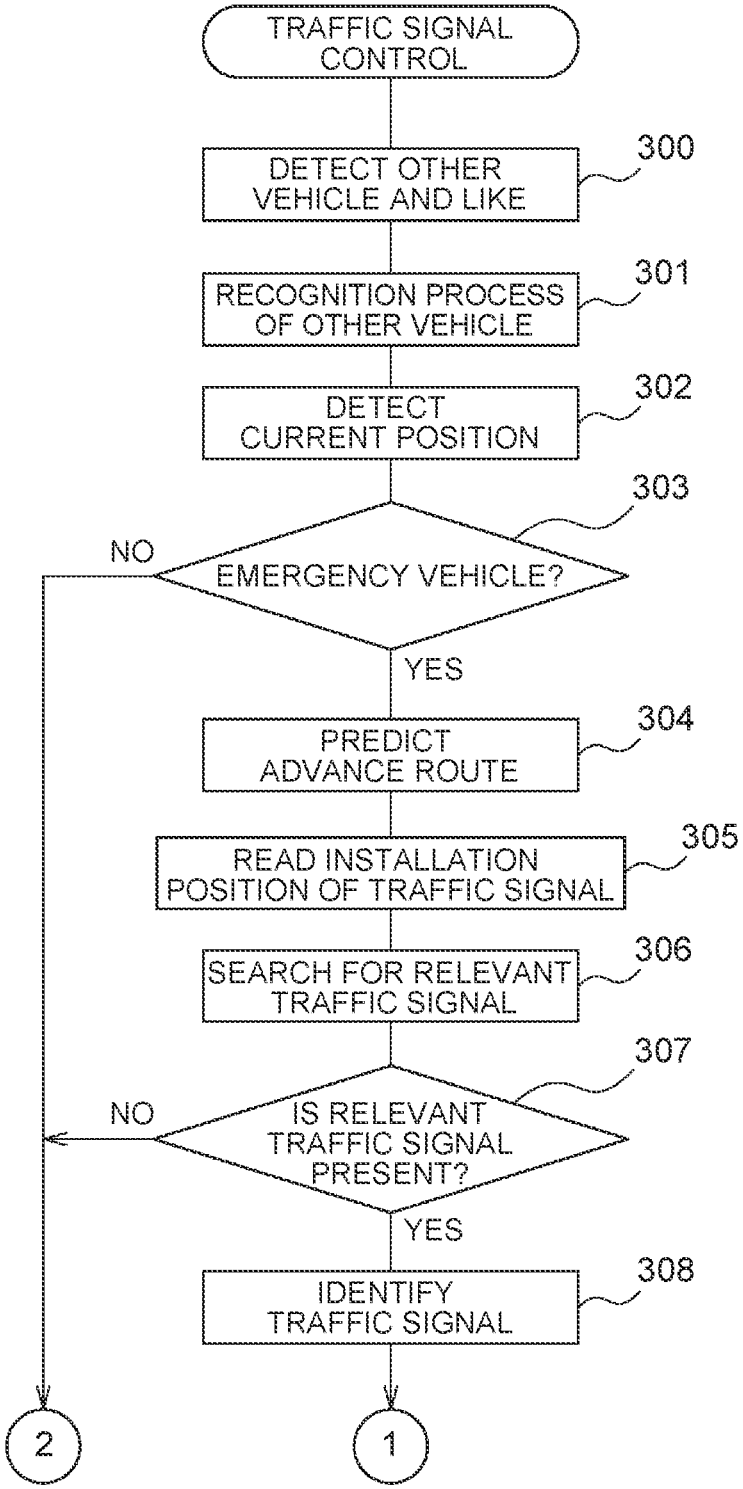
FIG. 18 is a flowchart for performing traffic signal control.
Figure 19:
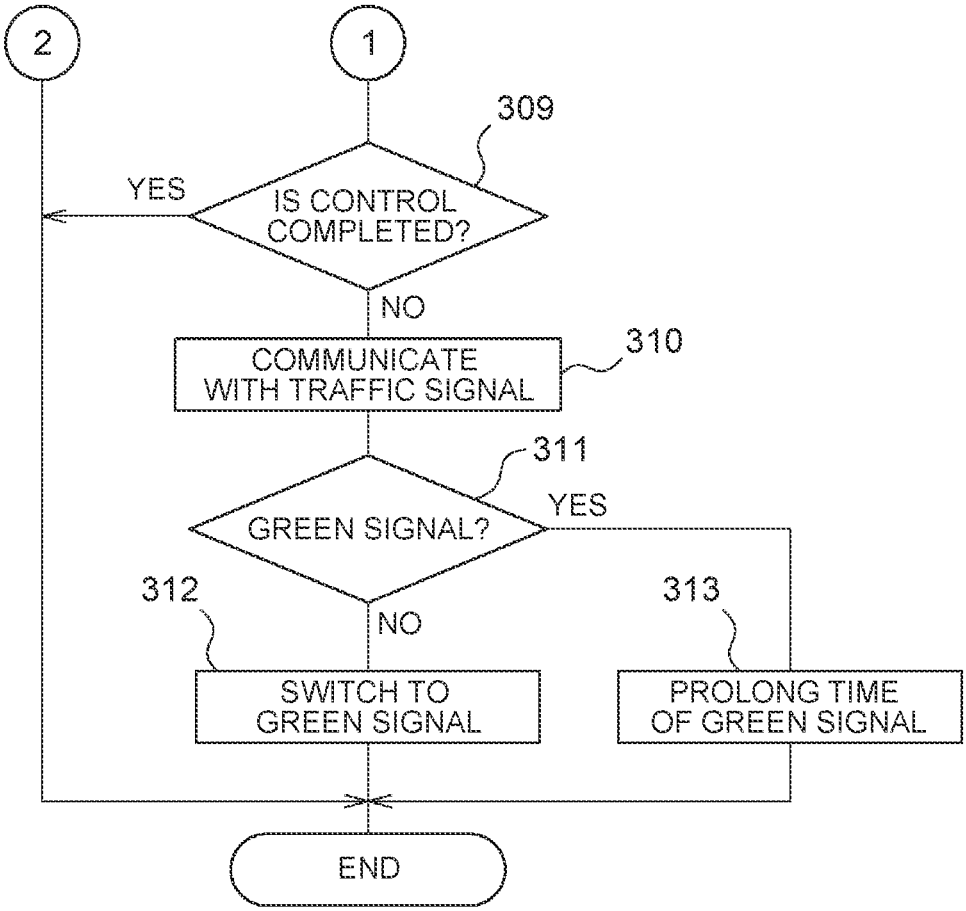
FIG. 19 is a flowchart for performing traffic signal control.

FIGS. 17 to 19 show a second modification of the second example according to the present disclosure. The second modification of the second example relates to the case where another vehicle 63 is an emergency vehicle. In the second modification of the second example, when it is estimated that the other vehicle 63 is an emergency vehicle and that the traveling state of the other vehicle 63 is an emergency traveling state, the electronic control unit 5 controls the traffic signal 61 installed ahead in the advance direction of the other vehicle 63. For example, in the second modification of the second example, when it is estimated that the other vehicle 63 is an emergency vehicle and that the traveling state of the other vehicle 63 is the emergency traveling state, the electronic control unit 5 switches the signal of the traffic signal, when the signal is other than a green signal, from the signal other than the green signal to the green signal, and prolongs the time of the green signal when the signal of the identified traffic signal is the green signal, so as to enable the other vehicle 63 to continue emergency traveling.

FIGS. 18 and 19 show a traffic signal control routine executed by interruption at constant time intervals in the electronic control unit 5 of the own vehicle 1 in order to implement the second modification of the second example according to the present disclosure.

With reference to FIGS. 18 and 19, first in step 300, the electronic control unit 5 detects another vehicle 63 traveling around the own vehicle 1, and the state around the other vehicle 63 with a camera that photographs a forward area, or a stereo camera that photographs the forward area. Then, in step 301, the electronic control unit 5 performs a recognition process of the other vehicle 63 based on the image photographed by the camera. Then, in step 302, the current position of the other vehicle 63 is detected. Then, in step 303, the electronic control unit 5 determines whether or not the other vehicle 63 is an emergency vehicle and that the traveling state of the other vehicle 63 is the emergency traveling state. In this case, for example, when it is recognized that the red light is lit based on the image photographed by the camera and that siren sound is acquired by an in-vehicle sound collector, the electronic control unit 5 determines that the other vehicle 63 is an emergency vehicle and that the traveling state of the other vehicle 63 is the emergency traveling state.

When the electronic control unit 5 determines that the other vehicle 63 is an emergency vehicle and that the traveling state of the other vehicle 63 is the emergency traveling state, the processing cycle proceeds to step 304 to predict the advance route of the other vehicle 63 based on the image photographed by the camera or the image photographed by the stereo camera. Then, in step 305, the electronic control unit 5 reads the installation position of the traffic signal. The installation position of the traffic signal is stored, for example, in the map data storage device 12. Then, in step 306, the electronic control unit 5 performs, based on the installation position of the traffic signal, a search for a traffic signal that is located on the predicted advance route of the other vehicle 63 and that is located within a set distance SX from the current position of the other vehicle 63, i.e. a search for a relevant traffic signal.

When a relevant traffic signal is not found as a result of the search, the electronic control unit 5 determines in step 307 that a relevant traffic signal is not present, and ends the processing cycle. In contrast, when a relevant traffic signal is found, the electronic control unit 5 determines in step 307 that a relevant traffic signal is present. As a consequence, the processing cycle proceeds to step 308 to identify the relevant traffic signal, i.e., the traffic signal to be controlled. Then, the processing cycle proceeds to step 309 to determine whether or not the control of the identified traffic signal is competed. When the control of the identified traffic signal is not yet completed, the processing cycle proceeds to step 310 to perform communication between the own vehicle 1 and the identified traffic signal. Then, in step 311, the electronic control unit 5 determines whether or not the signal of the identified traffic signal is the green signal. When the signal of the identified traffic signal is not the green signal, the processing cycle proceeds to step 312 to switch the signal of the identified traffic signal from the signal other than the green signal to the green signal. In contrast, when the signal of the identified traffic signal is the green signal, the processing cycle proceeds to step 313 to prolong the time when the signal of the identified traffic signal is the green signal.

What is claimed is:

1. A vehicle, comprising:

a sensor configured to detect a traffic signal installed in a travel route of the own vehicle, another vehicle traveling around the own vehicle, and another mobile object around the own vehicle; and an electronic control unit configured to:

recognize presence of the traffic signal, the other vehicle, and the other mobile object based on a detection result of the sensor;

determine, after recognition that the own vehicle has passed the traffic signal, whether or not there are the other mobile object moving toward the traffic signal and the other vehicle moving beside the other mobile object toward the traffic signal;

estimate a traveling state of the other vehicle;

communicate with the traffic signal; and control, when the electronic control unit determines that there are the other mobile object moving toward the traffic signal and the other vehicle moving beside the other mobile object toward the traffic signal, the traffic signal based on the traveling state of the other vehicle estimated by the electronic control unit.

2. The vehicle according to claim 1, wherein when the electronic control unit determines that the other mobile object moving toward the traffic signal and the other vehicle moving beside the other mobile object toward the traffic signal are present, the electronic control unit is configured to switch a signal of the traffic signal, when the signal is other than a red signal, from the signal other than the red signal to the red signal based on the traveling state of the other vehicle estimated by the electronic control unit, and prolong time of the red signal when the signal of the traffic signal is the red signal.

3. The vehicle according to claim 2, wherein when the electronic control unit determines that there are the other mobile object moving toward the traffic signal and the other vehicle moving beside the other mobile object toward the traffic signal and when a distance between the traffic signal and the other vehicle is shorter than a set distance, the electronic control unit is configured to switch a signal of the traffic signal, when the signal is other than a red signal, from the signal other than the red signal to the red signal based on the traveling state of the other vehicle estimated by the electronic control unit, and prolong time of the red signal when the signal of the traffic signal is the red signal.

4. The vehicle according to claim 2, wherein when the other mobile object is a pedestrian or a cyclist, and the electronic control unit estimates that there is the pedestrian or the cyclist around the other vehicle and that the traveling state of the other vehicle is a safe speed exceeding state exceeding a preset safe speed, the electronic control unit is configured to switch the signal of the traffic signal, when the signal is other than the red signal, from the signal other than the red signal to the red signal, and prolong the time of the red signal when the signal of the traffic signal is the red signal.

5. A traffic signal control method, comprising:

recognizing presence of a traffic signal installed in a travel route of an own vehicle, another vehicle traveling around the own vehicle, and another mobile object around the own vehicle based on a detection result of a sensor that detects the traffic signal, the other vehicle, and the other mobile object;

determining, after recognizing that the own vehicle has passed the traffic signal, whether or not there are the other mobile object moving toward the traffic signal and the other vehicle moving beside the other mobile object toward the traffic signal;

estimating a traveling state of the other vehicle;

communicating with the traffic signal; and controlling, when determining that there are the other mobile object moving toward the traffic signal and the other vehicle moving beside the other mobile object toward the traffic signal, the traffic signal based on the estimated traveling state of the other vehicle.

6. A non-transitory computer readable medium storing a program for causing a computer to perform functions, the functions comprising:

recognizing presence of a traffic signal installed in a travel route of an own vehicle, another vehicle traveling around the own vehicle, and another mobile object around the own vehicle based on a detection result of a sensor that detects the traffic signal, the other vehicle, and the other mobile object;

determining, after recognizing that the own vehicle has passed the traffic signal, whether or not there are the other mobile object moving toward the traffic signal and the other vehicle moving beside the other mobile object toward the traffic signal;

estimating a traveling state of the other vehicle;

communicating with the traffic signal; and controlling, when determining that there are the other mobile object moving toward the traffic signal and the other vehicle moving beside the other mobile object toward the traffic signal, the traffic signal based on the estimated traveling state of the other vehicle.

* * * * *